United States Patent [19]

Kessel

[11] 4,411,599

[45] Oct. 25, 1983

[54] DRAIN FITTING WITH BUILT-IN PUMP

[76] Inventor: Bernhard Kessel, Bahnhofstr. 31, 8071 Lenting, Fed. Rep. of Germany

[21] Appl. No.: 307,587

[22] Filed: Oct. 1, 1981

[30] Foreign Application Priority Data

Oct. 2, 1980 [DE] Fed. Rep. of Germany ..... 3037217

[51] Int. Cl.[3] ..... F04B 49/08; F04B 17/00

[52] U.S. Cl. ..... 417/301; 417/360; 417/424

[58] Field of Search ..... 417/40, 299, 360, 458, 417/361, 424, 301

[56] References Cited

U.S. PATENT DOCUMENTS

| | | | |
|---|---|---|---|
| 2,347,544 | 4/1944 | DeCosta et al. | 417/40 |
| 2,739,662 | 3/1956 | Sofia | 417/40 |
| 3,144,876 | 8/1964 | Frye | 417/559 |
| 3,220,351 | 11/1965 | Kling | 417/458 |
| 3,720,488 | 3/1973 | Bood | 417/360 |
| 4,080,104 | 3/1978 | Brown, Jr. | 417/40 |

FOREIGN PATENT DOCUMENTS

| | | | |
|---|---|---|---|
| 752942 | 7/1933 | France | 417/40 |
| 788955 | 8/1935 | France | 417/301 |
| 85274 | 1/1936 | Sweden | 417/361 |
| 651598 | 4/1951 | United Kingdom | 417/360 |

*Primary Examiner*—William L. Freeh
*Assistant Examiner*—Paul F. Neils
*Attorney, Agent, or Firm*—Karl F. Ross; Herbert Dubno

[57] ABSTRACT

A drain fitting has a vessel formed with a laterally open housing outlet, at least one inlet, and an internal seat at the outlet. A pump is provided in the vessel and has a pump housing secured to the seat and having a pump output extending into the outlet and a pump intake, an impeller displaceable to move liquid through the housing from the intake to the output, and a motor in the housing driving the impeller. A check valve is provided in the pump output for preventing liquid flow back into the pump housing as well as means releasably securing the pump on the seat in the vessel. The pump housing is substantially closed and has its intake substantially lower than its output so that it acts as a gas trap.

14 Claims, 7 Drawing Figures

DRAIN FITTING WITH BUILT-IN PUMP

FIELD OF THE INVENTION

The present invention relates to a drain fitting. More particularly this invention concerns a drain fitting used when the liquid level in the drain occasionally is higher than the drain outlet.

BACKGROUND OF THE INVENTION

Normally no matter how many soil and rain stacks a building has, there is only one connection—the so-called sewer service line—to the sewer main that runs under the street. The sewer service line itself runs as a rule at a slight incline, of at least 3°, from the building down to the sewer main. In many areas, particularly ones where the sewers were laid down a long time ago, the sewer main is not very deep. As a result when the sewer system is heavily loaded, either by a heavy rain or simply by many users employing a line intended for lighter use, the effective liquid level in the sewer can be higher than that of the in-house drain, that is the sewer main can be completely full whereas it is normally only intended to run partially full. In such situations sewage can back up through the service line into the house drain and thence into the basement with the obvious unpleasant results.

It is possible to protect against the worst effects of such a situation by the simple expedient of putting a backflow preventer or check valve in the sewer service line. Thus no sewage from outside can back up through the drain into the basement. Nonetheless since there is considerable back pressure holding the check valve closed, any waste descending the in-house waste lines will not be able to exit, and will simply rise up out of the lowermost drains in the building, creating on a small scale the same problem as with no check valve.

The disadvantages of the above-described arrangement can be overcome by a system wherein the building drain is not connected directly to the service line, but to the intake of a pump whose output is connected to an elevated sump or storage vessel itself connected via a service line to the sewer main. The storage facility itself is provided at a level which is much higher than than the highest possible liquid level in the sewer main, so that sewage cannot possibly flow back through the storage vessel. Thus waste is pumped uphill by this pump to the elevated storage facility and then flows by gravity down into the sewer main. With such a system the pump must lift all waste, even when the liquid level in the sewer main is below that in the building drain, since the path to the sewer main has a high point over which the waste must be pumped. Obviously such a system uses a considerable amount of energy to operate the pump, and requires that a very heavy-duty pump be used. Furthermore any failure of the pump will result, whether or not the drain liquid level is above or below the level in the building drain, in a backup of waste in the building.

It has also been suggested in German patent document 1,057,984 to provide a collecting sump in the building drain having a weir subdividing this sump into an upstream portion into which liquid waste flows from the building and a downstream portion connected via the sewer service line to the sewer main. A check valve is provided in the sewer service line. A float arrangement provided in the downstream portion of the collecting sump is actuated when liquid level in the downstream portion exceeds a predetermined level, as occurs when the sewer liquid level rises to close the check valve and sewage cannot flow out of the downstream portion. A pump is connected between this downstream portion and a bypass conduit in turn connected to the service line downstream of its check valve and is operated by this float arrangement to pump the waste via the bypass conduit into the service line in the event of a backup, as the pump is capable of generating sufficient pressure to overcome the back pressure in the line.

This system has the considerable advantage that the pump only operates when the effective liquid level in the sewer main is dangerously high. As a result no energy is used under normal circumstances. Furthermore it is possible to employ a relatively light-duty pump, as compared to the continuous-duty pump needed in the other above-described pump system, as the pump only operates periodically and need only be able to move the waste from a single building. Still this arrangement requires considerable extra plumbing, and normally excavation of the sewer service line in order to install it in an existing drain system. Thus the first costs are quite high.

OBJECTS OF THE INVENTION

It is therefore an object of the present invention to provide an improved drain fitting.

Another object is the provision of such a drain fitting which overcomes the above-given disadvantages.

SUMMARY OF THE INVENTION

These objects are attained according to the instant invention in a drain fitting having a vessel formed with a laterally open housing outlet, at least one inlet, and an internal seat at the outlet. A pump is provided in the vessel and has a pump housing secured to the seat and having a pump output extending into the outlet and a pump intake, an impeller displaceable to move liquid through the housing from the intake to the output, and a motor in the housing driving the impeller. A check valve is provided in the pump output for preventing liquid flow back into the pump housing as well as means releasably securing the pump on the seat in the vessel.

Thus the system according to the instant invention can be retrofitted relatively easily into an existing typical drain of the type provided at the upstream end of the sewer service line. Means is provided according to this invention for operating the pump to force liquid through the check valve into the service line when the liquid level in the vessel exceeds a predetermined limit, so that the system only operates when the effective liquid level in the sewer main is above the liquid level in the vessel.

According to further features of this invention the fitting is provided with seal means between the pump output and the housing outlet for preventing flow from the vessel into the housing outlet except through the pump output. This seal means includes seals fitted between the pump housing and the vessel. The pump output according to the invention is above the pump intake and the pump housing is substantially closed except at the output and intake, so that the pump housing acts as a gas trap.

According to this invention the pump housing is formed with a pump passage and a bypass passage. The pump passage passes over the impeller and the bypass passage past the impeller. In addition the pump is provided with a valve member displaceable between one position blocking the pump passage and permitting flow through the bypass passage and another position blocking the pump passage and permitting flow through the bypass passage. This valve member is a flap pivotal on the pump housing adjacent the intake. The pump passage includes a pumping chamber containing the impeller and closed on one side by the flap in the one position. The flap is so oriented that when the pump impeller is driven by its motor it pressurizes the pump chamber to force the flap into a position blocking the bypass passage, but when the pump impeller is not driven the flap blocks the pump passage for flow through the pump via the bypass passage. As a result the pump impeller will not be exposed to a constant flow of dirty liquid when it is not actually pumping, and flow through the fitting according to this invention is not impeded by the impeller when same is not being driven.

The uppermost portion of the intake is spaced below the lowermost portion of the output by a distance equal generally to the height of the output. Thus good flow will be obtained through the arrangement according to this invention, with good gas-blocking ability. Similarly the flow cross-sections of the two passages are each as large as that of the output, so that the system according to the instant invention will not impede flow into the service line.

The motor according to the present invention is electric and is provided with a feed wire, the vessel being formed with a throughgoing opening through which the wire passes and provided with a seal snugly surrounding the wire. A special conduit screwed via appropriate fittings to the vessel contains this wire.

It is also possible according to the invention to provide a connecting pipe between the pump housing and the outlet. Furthermore it lies within the scope of this invention to provide the motor outside the vessel.

According to this invention the pump can have a removable output tube forming the pump output and provided with the check valve. This output tube includes a pair of fitted-together and coaxial tube parts each provided with a respective such check valve. Releasable connecting means between the tube parts and the pump housing secures the tube parts together and secures the tube parts to the pump housing. The pump housing is provided at the outlet with a collar snugly fitting in the outlet and fitted in turn into the tube. The seal means includes a seal ring surrounding the collar and annularly engaging the vessel around the outlet. The check valve has a pivotal valve flap, or it can have a valve element formed by a ball.

DESCRIPTION OF THE DRAWING

The above and other features and advantages will become more readily apparent from the following, reference being made to the accompanying drawing in which.

SPECIFIC DESCRIPTION

Figure 1:
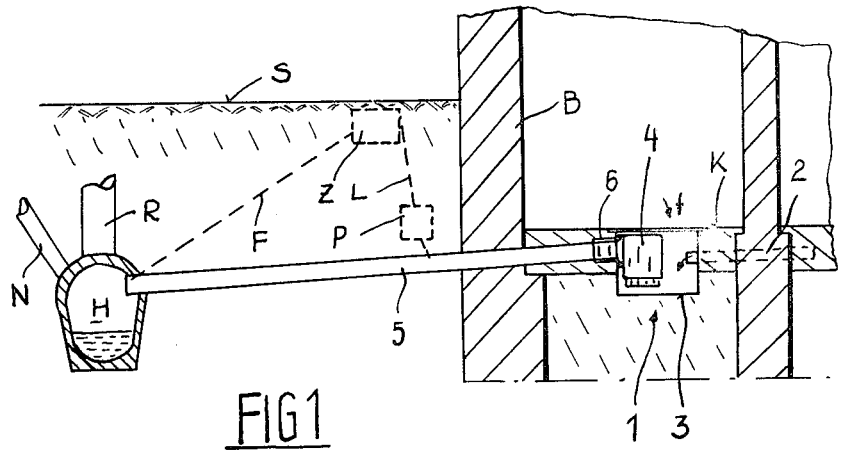
FIG. 1 is a small-scale schematic view of a system incorporating the fitting of the instant invention.

As seen in FIG. 1 the system according to this invention has a sewer main H provided well below ground level S and provided with manhole-access passages R, inputs N, and standard sewer service lines 5 which are normally tipped at about a 3° slope to the horizontal toward the main H. Each such service line 5 is connected to the outlet 6 of a drain fitting 1 provided in the basement K of a building B. The drain fitting 1 has according to this invention a vessel 3 in which a pump 4 acts as a gas trap and into which a waste line 2 empties.

In the prior-art systems, as shown in dashed lines, the service line 5 is interrupted and connected to the intake of a pump P connected via a line L to a sump or storage vessel Z provided much higher than the sewer main H and connected through a steeply pitched service line F to the main H. This pump P operates nearly continuously to displace all liquid waste from the building B up to the vessel Z, whence it flows by gravity down to the main H.

Figure 2:
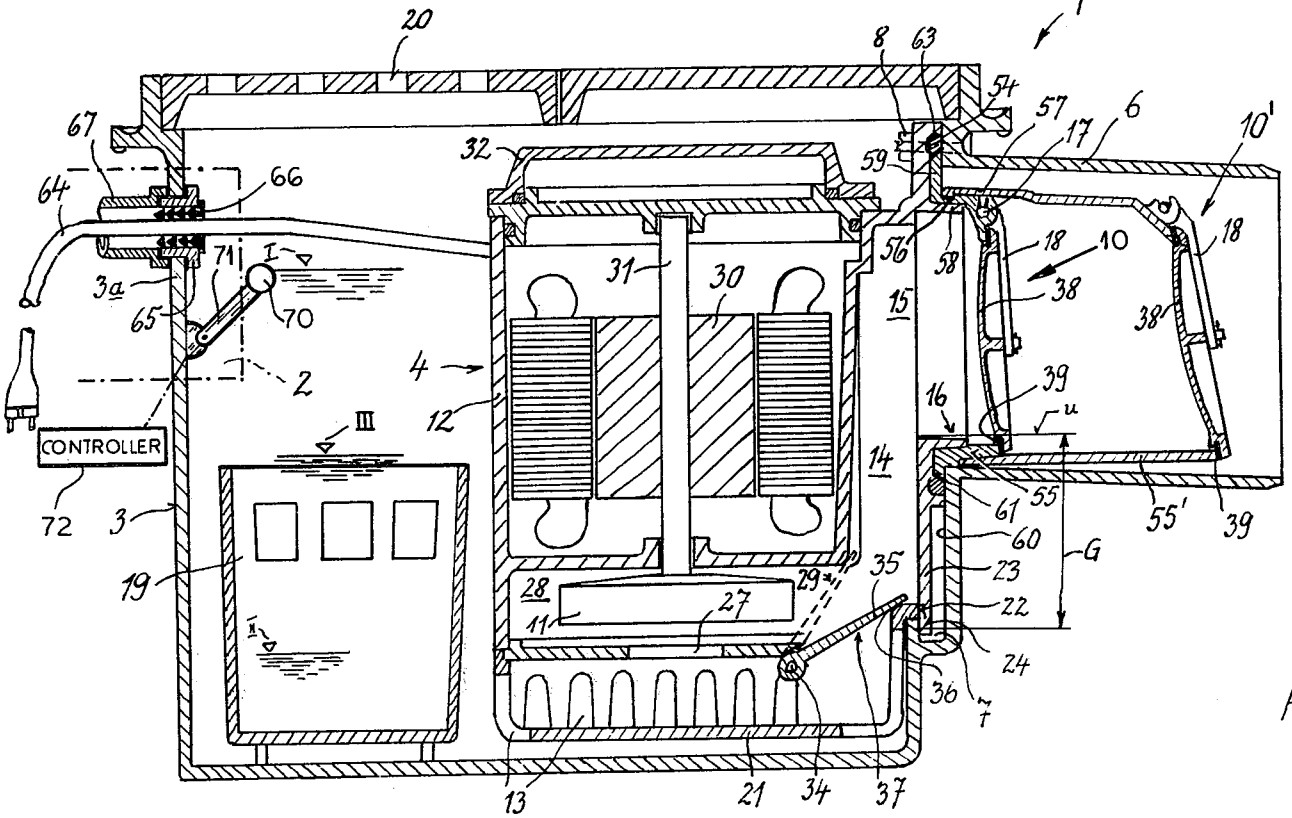
FIG. 2 is a large-scale sectional view of the fitting according to this invention.

As seen in more detail in FIG. 2 the vessel 3 is of standard construction, corresponding to the usual shape, size, and dimensions for a floor drain that constitutes the last connection between the household drain lines 2 and the service line 5. According to this invention the vessel 3 is formed with a seat 7 and is provided with studs or bolts 8 that allow a flange 23 of the pump 4 to be fixed in place at the outlet 6.

This pump 4 itself is a nonpositive displacement, axial-input/radial output pump having a rotor 30 whose shaft 31 carries an impeller 11 provided in a pump chamber 28 having a downwardly directed axial input 27 and a horizontally directed radial output 29. The pump 4 has a closed multipart housing 12 with a carrying bale 32 and a lower part 21, which latter is formed with horizontally opening intakes 13. Thus this housing forms a main downstream passage portion 14 opening at one end at the pump output 15 and at the other end either through the pump-chamber output 29 into the chamber 28 or through another passage portion 37 into the region of the intakes 13. Between the lower edge u of pump output 15 and the upper edges of the intake openings 13 is a vertical distance G which therefore constitutes a gas trap when the vessel is filled at least to a level III with liquid waste, as the pump housing 12 is closed except at the intakes 13 and output 15.

A valve 37 is constituted by a valve flap 35 pivoted at 34 on the pump housing 12 and movable between a position shown in solid lines blocking the passage portion 36 and a position shown in dashed lines blocking the pump-chamber output 29. When the pump 4 is not energized flow through the portion 36 normally pushes this flap 35 into the dashed-line position so that flow through the pump 4 bypasses the pump chamber 28, as the resistance to flow through the pump chamber 28 is greater than passing it through the bypass passage 36. When the pump 4 is energized to rotate the impeller 11, however, the flap 35 moves down to block the bypass passage 36 and allow flow through the pump 4 to take place exclusively via the pumping chamber 28.

The pump 4 is provided at the pump output 15 with an output tube 16 formed by a pair of output-tube parts 55 and 55' which have slightly frustoconical ends so that they can fit snugly into each other, with the inner tube part 55 fitting over a collar 58 of the pump housing 12 and having a flange 59 clamped between an inner wall 60 of the vessel 3 and the pump housing 12. The end of the tube part 55 forms a pivot 17 for a lever 18 carrying a flap 38 which is engageable on a seat 39 of the tube part 55 to form an inner flap-type check valve 10. The outer tube part 55' engages with integral fingers 57 in recesses 56 in the inner tube part 55 to hold itself in place thereon, these fingers 57 deforming elastically as the two parts 55 and 55' are fitted together. Another check valve 10' of construction identical to that of the check valve 10 of the inner tube part 55 is provided on the outer part 55'. Either of these valves 10 or 10' could be provided with manual actuation means, so that the fitting could be manually closed if desired.

The pump housing 12 is formed with a flange 23 at the output 15 and having a lower edge 24 received in the pocket 7. The bolts or studs 8 engage through the upper portion of this flange 23 to hold the pump 4 rigidly but removably in place in the vessel 3. A seal ring 54 is received in a groove 63 of the flange 23 and is compressed between this flange 23 and the inner vessel surface 60. In order to ensure a good fit and seal at the pump output 15, the inner tube part 55 has a radially outer surface 61 that is frustoconically tapered and that presses radially outwardly against the inner periphery of the seal ring 54.

The vessel 3 is provided internally adjacent the pump 4 with a particle trap 19 constituted as an upwardly open small vessel positioned directly under the holes 20 of a removable cover of the drain fitting 1 and also under the location where the conduit or conduits 2 empty into the vessel 3. A float 70 is carried on an arm 71 above the particle-trap vessel 19 and is connected to a controller 72 that switches the pump 4 on and off. To this end the pump 4 has a feed wire 64 that passes out of a side wall 3*a* of the vessel 3 through a fitting formed of a pair of screwed together parts 65 and 67 compressing labyrinth-style seals 66.

When the liquid level inside the vessel 3 rises to the level indicated at I, which is well above the lowermost part u of the outlet 15, the controller 72 switches on the pump 4 to force the liquid into the outlet 16 and thence into the service line 5 past the check valves 10 and 10'. Unless there is back pressure holding the check valves 10 and 10' closed, the vessel 3 normally is not full above the level indicated at III, which level III is only slightly above the lowermost portion u of the outlet 15.

Figure 3:
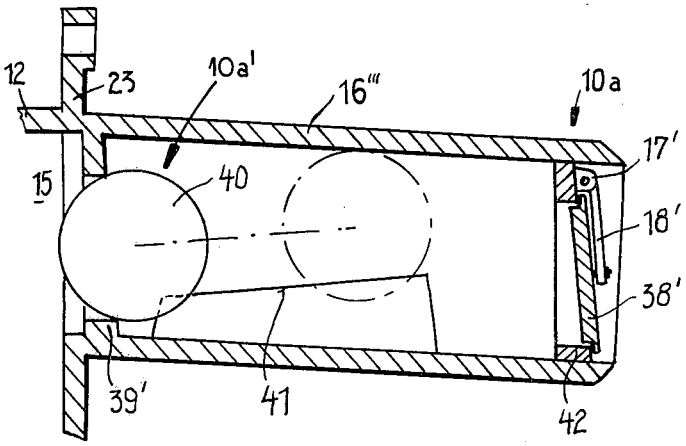
FIGS. 3, 4, and 5 are sections through details of various alternative portions of the fitting of the present invention.

FIG. 3 shows an arrangement similar in function to the arrangement of FIG. 2, but wherein an outlet tube 16''' has a seat 39' for an inner check valve 10*a*' whose valve member is a ball 40 rollable on an incline 41 upward away from the seat 39. The outer check valve 10 is identical to the inner check valve 10 of FIG. 2, having a valve flap 38' carried on an arm 18' pivoted at 17' and engageable with an annular seat 42.

Figure 4:
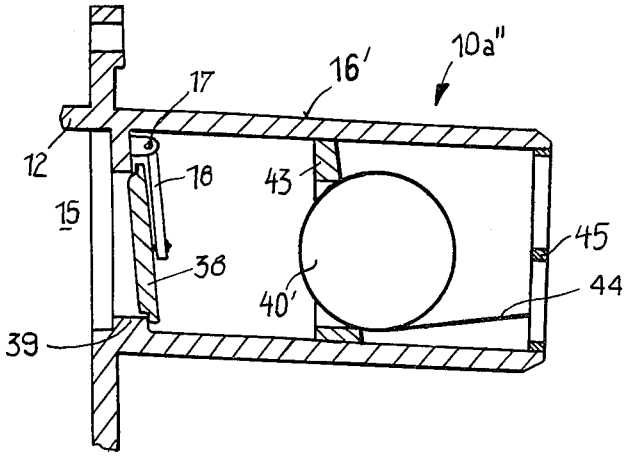

FIG. 4 shown as arrangement similar to that of FIG. 3 but wherein an outlet tube 16 has an inner check valve 10 identical to that of FIG. 2, and wherein an outer check valve 10*a*'' is provided with a valve seat 43 for a ball 40' ridable along an incline 44 and captured in the tube 16' by a grate 45.

Figure 5:
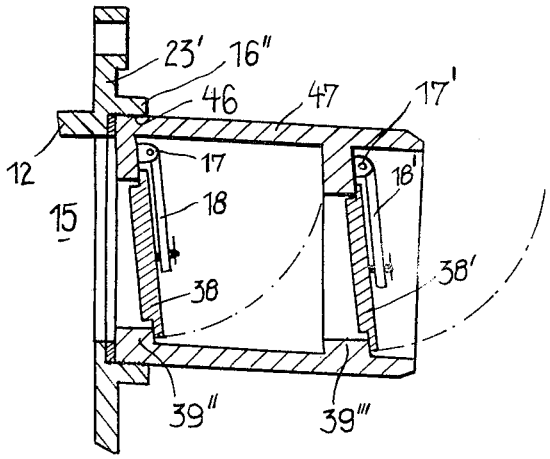

In FIG. 5 the housing 12 has a collar 16'' extending from its flange 23' and provided with a one-piece outlet tube 47 forming two seats 39'' and 39''' for flap-type check valves identical to those of FIGS. 2 and 3, respectively.

Figure 6:
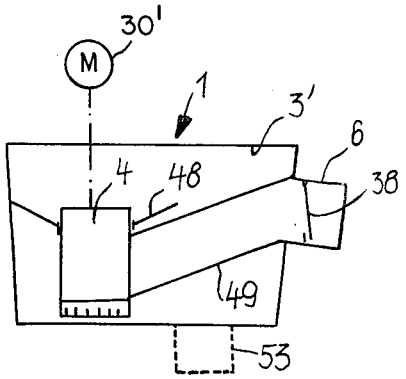
FIGS. 6 and 7 are small-scale schematic views of further alternative structures according to the invention.

In FIG. 6 and arrangement is shown where the pump 4 is suspended on holders 48 inside the vessel 3' and is connected to the outlet 6 by a short conduit 49. In addition the motor 30' here is mounted outside the vessel 3'.

Figure 7:
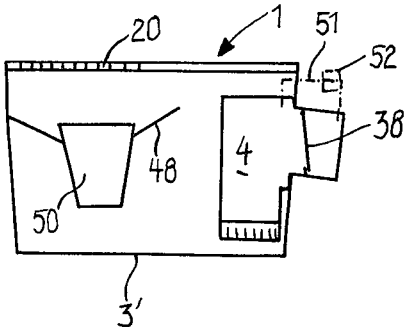

The arrangement of FIG. 7 has a particle trap 50 mounted on the holders 48 and the pump 4 is provided at its outlet with an additional small-diameter conduit 51 that bypasses the check-valve flap 38 and itself provided with a small check valve 52. Thus the pump 4 can work against the little check valve 52, which will take substantially less head to open so that the pump 4 can be a relatively light-duty pump. In such an arrangement the vessel 3' can be dimensioned rather large so that the light-duty pump 4 need not be able to handle peak loads.

The system according to the instant invention therefore can take the place of a standard drain fitting, and can even be retrofitted into a standard drain fitting. It only functions when there is a backup in the service line, which rarely occurs more often than a few times a year, so that when there is no dangerous condition it consumes no energy. What is more, it can be easily serviced by removal of the entire pump and gas-trap assembly, and removal of this assembly gives good access to the service line 6 in the event it has to be snaked out.

I claim:

1. A drain fitting comprising:

a vessel formed with a laterally open outlet, at least one inlet, and an internal seat at said outlet;

a pump in said vessel and having a pump housing secured to said seat and having a pump intake and a pump output extending into said outlet above said intake, said pump housing being substantially closed except at said output and intake, whereby said pump housing acts as a gas trap, said pump housing being formed with a pump passage and a bypass passage, said passages forming the only connection between said inlet and said outlet, whereby flow between said inlet and outlet must be through said passages, an impeller in said pump passage displaceable to move liquid through said pump housing from said intake to said output, a valve member displaceable between one position blocking said pump passage and permitting flow through said bypass passage and another position blocking said bypass passage and permitting flow through said pump passage and over said impeller, and means including a motor in said pump housing for driving said impeller and thereby moving said valve member into the other position;

a check valve in said pump output preventing liquid flow back into said pump housing; and seal means between said pump output and said outlet for preventing flow from said vessel into said outlet except through said pump output;

means releasably securing said pump on said seat in said vessel.

2. The fitting defined in claim 1 wherein said seal means includes seals fitted between said pump housing and said vessel.

3. The fitting defined in claim 1 wherein said motor is electric and is provided with a feed wire, said vessel being formed with a throughgoing opening through which said wire passes and provided with a seal snugly surrounding said wire.

4. The fitting defined in claim 1, further comprising a connecting pipe between said pump housing and said outlet.

5. The fitting defined in claim 1 wherein said motor is outside said vessel.

6. The fitting defined in claim 1 wherein said check valve has a pivotal valve flap.

7. The fitting defined in claim 1 wherein said check valve has a valve element formed by a ball.

8. The fitting defined in claim 1, further comprising means for operating said pump and thereby displacing liquid from said vessel through said check valve when the liquid level in said vessel exceeds a predetermined upper limit.

9. The fitting defined in claim 1 wherein said pump housing has a removable output tube forming said pump output and provided with said check valve.

10. The fitting defined in claim 9 wherein said output tube includes a pair of fitted-together and coaxial tube parts each provided with a respective such check valve.

11. The fitting defined in claim 10 wherein further comprising releasable connecting means between said tube parts and said pump housing for securing said tube parts together and for securing said tube parts to said pump housing.

12. A drain fitting comprising:

a vessel formed with a laterally open outlet, at least one inlet, and an internal seat at said outlet;

a pump in said vessel and having a pump housing secured to said seat and having a pump intake and a pump output extending into said outlet above said intake, said pump housing being substantially closed except at said output and intake, whereby said pump housing acts as a gas trap, said pump housing being formed with a pump passage and a bypass passage, said pump passage passing over said impeller and said bypass passage past said impeller, said passages forming the only connection between said inlet and said outlet, whereby flow between said inlet and outlet must be through said passages, an impeller displaceable to move liquid through said pump housing from said intake to said output, a valve member comprising a flap pivotal on said pump housing displaceable between one position blocking said pump passage and permitting flow through said bypass passage and another position blocking said bypass passage and permitting flow through said pump passage, said pump passage including a pumping chamber containing said impeller and closed on one side by said flap in said one position, and a motor in said pump housing driving said impeller;

a check valve in said pump output preventing liquid flow back into said pump housing; and seal means between said pump output and said outlet for preventing flow from said vessel into said outlet except through said pump output;

means releasably securing said pump on said seat in said vessel.

13. A drain fitting comprising:

a vessel formed with a laterally open outlet, at least one inlet, and an internal seat at said outlet;

a pump in said vessel and having a pump housing secured to said seat and having a pump intake and a removable outlet tube forming a pump output extending into said outlet above said intake, said pump housing being substantially closed except at said output and intake, whereby said pump housing acts as a gas trap, said pump housing being provided at said outlet with a collar snugly fitting in said outlet and fitted in turn into said tube, an impeller displaceable to move liquid through said pump housing from said intake to said output, and a motor in said pump housing driving said impeller;

a check valve in said outlet tube preventing liquid flow back into said pump housing; and seal means between said pump output and said outlet for preventing flow from said vessel into said outlet except through said pump output;

means releasably securing said pump on said seat in said vessel.

14. The fitting defined in claim 13 wherein said seal means includes a seal ring surrounding said collar and annularly engaging said vessel around said outlet.

* * * * *